US007367825B2

(12) United States Patent
Tsukashima et al.

(10) Patent No.: US 7,367,825 B2
(45) Date of Patent: May 6, 2008

(54) CONNECTOR CONNECTION STRUCTURE

(75) Inventors: Hiroyuki Tsukashima, Toyota (JP); Takamasa Takeuchi, Anjo (JP); Kazumoto Konda, Yokkaichi (JP); Sho Miyazaki, Yokkaichi (JP)

(73) Assignees: Toyota Jidosha Kabushiki Kaisha, Toyota (JP); Aisin AW Co., Ltd., Anjo (JP); Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 44 days.

(21) Appl. No.: 10/582,686

(22) PCT Filed: Jan. 4, 2005

(86) PCT No.: PCT/JP2005/000160

§ 371 (c)(1),
(2), (4) Date: Jun. 13, 2006

(87) PCT Pub. No.: WO2005/067106

PCT Pub. Date: Jul. 21, 2005

(65) Prior Publication Data

US 2007/0117429 A1 May 24, 2007

(30) Foreign Application Priority Data

Jan. 9, 2004 (JP) ..... 2004-004443
Mar. 18, 2004 (JP) ..... 2004-078820

(51) Int. Cl.
*H01R 13/62* (2006.01)

(52) U.S. Cl. ..... 439/157; 439/372

(58) Field of Classification Search ..... 439/157, 439/372

See application file for complete search history.

(56) References Cited

U.S. PATENT DOCUMENTS

| | | | | |
|---|---|---|---|---|
| 5,362,245 | A | 11/1994 | Suguro et al. | |
| 5,980,283 | A * | 11/1999 | Okabe | 439/157 |
| 6,056,582 | A | 5/2000 | Okabe | |
| 6,164,992 | A * | 12/2000 | Okabe | 439/157 |
| 6,174,179 | B1 * | 1/2001 | Okabe | 439/157 |
| 6,644,991 | B2 * | 11/2003 | Martin | 439/157 |
| 6,767,231 | B1 * | 7/2004 | Martin et al. | 439/157 |
| 6,913,474 | B2 * | 7/2005 | Mikhail et al. | 439/157 |
| 2006/0030185 | A1 * | 2/2006 | Hamoignon | 439/157 |

FOREIGN PATENT DOCUMENTS

JP U 54-75989 5/1979

(Continued)

*Primary Examiner*—Tho D. Ta
(74) *Attorney, Agent, or Firm*—Oliff & Berridge, PLC

(57) ABSTRACT

A connector connection structure includes: a female connector on a housing accommodating a dynamo-electric machine mounted in a vehicle; and a male connector shaped so as to be fitted into the female connector by inserting it with a force not smaller than a predetermined amount. The male connector includes a contact joinable with a contact of the female connector to be electrically connected, and a rod-like lever connected with the male connector via a fulcrum. The lever generates the force not smaller than a predetermined amount by applying, with its one end's position being restricted, a rotation force to the other end. The housing includes a protrusion for restricting the position of the one end.

28 Claims, 9 Drawing Sheets

FOREIGN PATENT DOCUMENTS

| | | |
|---|---|---|
| JP | A 6-68933 | 3/1994 |
| JP | U 6-24322 | 3/1994 |
| JP | A 6-124747 | 5/1994 |
| JP | A 7-106018 | 4/1995 |
| JP | A 10-125397 | 5/1998 |
| JP | A 11-26070 | 1/1999 |
| JP | A 11-102747 | 4/1999 |
| JP | A 2002-75557 | 3/2002 |

* cited by examiner

CONNECTOR CONNECTION STRUCTURE

TECHNICAL FIELD

The present invention relates to a connector connection structure, and particularly to a structure to reduce the insertion load of a connector.

BACKGROUND ART

Conventionally, several electric devices are mounted on a Hybrid Vehicle (HV), Electric Vehicle (EV) and Fuel Cell Vehicle (FCV). For example, in a vehicle including a dynamo-electric machine mounted on it, the dynamo-electric machine is connected with electric devices such as inverters via a cable, such as a wire. The cable, such as a wire, is generally connected to the electric devices by a connector. Specifically, a cable and an electric device have their respective connectors having a geometry that allows them to be fitted into each other. Each connector works as a male or female connector and has a contact for establishing electrical connection. By fitting a male connector into a female connector, their contacts are thus joined together to be electrically connected. The male connector can be fitted into the female connector by applying a force not smaller than a predetermined amount. Fitting of such connectors may be performed by clamping of bolts, for example. The following publications disclose techniques for connector fitting by clamping of bolts.

Japanese Patent Laying-Open No. 2002-75557 discloses a shield connector that allows a shield wire to extend in a direction parallel to a shield wall of the other part and that can be made smaller. The shield connector has a housing covering a terminal of the shield wire, which housing accommodates the base end of a metal terminal crimped onto the conductor of the shield wire. The shield connector is attached to a through hole formed in the shield wall of the other part. The shield layer of the shield wire is then conductively connected to the shield wall of the other part and the tip end of the metal terminal is held projecting into the shield wall of the other part. The metal terminal of the shield connector is as a whole L-shaped, where a flat portion continuing from the crimping portion of the conductor is bent. Then, the portion of the metal terminal from the base end to a position near the tip end is covered by an insulating member. A shield member is provided in the housing that covers the insulating member covering the metal terminal. One end of the shield member continues to or is conductively connected to the shield layer of the shield wire. The other end is disposed on the portion of the housing which abuts to the shield wall of the other part.

In the case of the shield connector disclosed in the above publication, at one end of the housing, the metal terminal crimped onto the conductor of the shield wire projects into the shield wall when the housing of the shield connector is attached to the shield wall of the other part. At the other end of the housing, the shield wire extends parallel to the shield wall of the other part. The metal terminal is L-shaped where the flat portion extending from the crimp portion is bent at right angles, where the flat portion may be bent at a radius smaller than that for the shield wire. Consequently, the bent portion and thus the entire shield connector may be made smaller.

To improve the operability, a connector's insertion load may be reduced, for example, by using a levered connector in which a lever is provided on the male connector and an arm is formed on the female connector. When the male connector is fit into the female connector, the lever is hooked into the arm to provide a reduction in insertion load. The following publication discloses a technique of a levered connector.

Japanese Patent Laying-Open No. 7-106018 discloses a levered connector that prevents a lever from slipping out of a connector housing with a simple structure. This levered connector has a U-shaped lever rotatable on a connector housing of one of the connectors coupled to each other, the lever straddling the connector housing. The other's connector housing is provided with a cam receiver engaging with a cam formed on the lever, and the lever is reciprocally rotated to displace the cam receiver, thereby coupling and decoupling the connectors. The levered connector has a lever support shaft projecting from either one connector housing or the lever as well as a shaft receiving hole on the other into which the lever support shaft is fitted. One of the lever support shaft and the shaft receiving hole has a radially projecting slippage stop. The other is provided with an engagement surface that engages with the slippage stop during the reciprocal rotation of the lever, the engagement surface having a portion radially notched and allowing the slippage stop to be inserted and removed in a decoupling position of the lever.

In the levered connector disclosed in the above publication, the lever is positioned in a decoupling position of the connectors to attach the lever to the connector housing. Then, the slippage stop formed on one of the lever support shaft and the shaft receiving hole is inserted into the notch on the engagement surface of the other. To operate the lever to couple the connectors, the lever is rotated from its decoupling position to the coupling position. Accordingly, the lever is bent due to the operation force for the insertion load acting upon the lever as the connectors are coupled. Thus, the slippage stop engages with the engagement surface to prevent the lever support shaft from being removed from the shaft receiving hole even when a force acts in a direction that would cause the lever support shaft to be removed from the shaft receiving hole.

However, when a dynamo-electric machine is mounted on an HV of Front engine Rear drive (FR), for example, the dynamo-electric machine needs to be mounted in a center tunnel of a vehicle that has a small mounting space. The operability in coupling connectors is low when a cable is connected to a dynamo-electric machine after the machine is mounted in the center tunnel by fitting connectors to each other by clamping of bolts, for example, as in a shield connector disclosed in the above publication.

To mount a dynamo-electric machine on a large HV of FR, requirements for the dynamo-electric machine are high and the dynamo-electric machine itself is large, and thus overhanging of connectors and the like from the dynamo-electric machine needs to be minimized. Specifically, for larger dynamo-electric machines, the connectors need to have larger terminals to resist higher voltages. Thus, the insertion load of the connectors is very high, and a mechanism for reducing the insertion load such as a levered connector as disclosed in the above publication would result in a very large connector. Accordingly, the connectors and the like overhang from the housing of the dynamo-electric machine, requiring the larger mounting space.

DISCLOSURE OF THE INVENTION

An objection of the present invention is to provide a thinner connector connection structure that enables fitting by an insertion load reduction mechanism with a simple structure.

A connector connection structure according to an aspect of the present invention is a connector connection structure including: a first connector on a housing accommodating an electric device mounted in a vehicle; and a second connector shaped so as to be fitted into the first connector by inserting it with a force not smaller than a predetermined amount. The second connector has a contact joinable with a contact of the first connector to be electrically connected. The second connector includes a mechanism that is integral therewith for increasing a force applied by an operator for insertion.

According to the present invention, the connector connection structure is a connector connection structure including: a first connector (for example, a female connector) provided on a housing accommodating an electric device (for example, a dynamo-electric machine) mounted in a vehicle; and a second connector (for example, a male connector) shaped so as to be fitted into the female connector by inserting it with a force not smaller than a predetermined amount. The male connector has a contact joinable with a contact of the female connector to be electrically connected. The male connector includes a mechanism (for example, a lever rotatably supported on a male connector) that is integral therewith for increasing a force applied by an operator for insertion. Accordingly, when a protrusion, for example, is provided on the housing for restricting the position of one end of the lever, the lever generates a force not smaller than a predetermined amount by applying, with its one end's position being restricted, a rotation force to the other end. The lever provided on the male connector to increase the force applied for insertion can achieve reduction in the insertion load provided by the operator. It further eliminates the necessity for a structure on the female connector corresponding to the mechanism on the male connector. The lever on the male connector only needs to have a simple structure specialized as a lever structure. Thus, the connectors, when fitted into each other, can be thinner in size in the fitting direction. Further, the connectors can be connected with each other in a small operation space. In this way, overhanging of the connectors from the housing can be minimized, thereby ensuring a mounting space for a dynamo-electric machine even when only a small space is available. Further, the lever structure for the connectors can be smaller and simpler and thus advantageous in terms of cost. Accordingly, a thinner connector connection structure can be provided that enables fitting by an insertion load reduction mechanism with a simple structure.

Preferably, the mechanism includes a rod-like insertion assist member connected to the second connector via a fulcrum. The insertion assist member generates the force not smaller than a predetermined amount by applying, with its one end's position being restricted, a rotation force to the other end. The housing includes a restriction element for restricting the position of the one end.

According to the present invention, the mechanism includes a rod-like insertion assist member (for example, a lever rotatably supported on a male connector) connected to the second connector (for example, the male connector) via a fulcrum. The lever generates the force not smaller than a predetermined amount by applying, with its one end's position being restricted, a rotation force to the other end. The housing includes a restriction element (for example, a protrusion provided on the housing and formed in a position for the one end) for restricting the position of the one end. This eliminates the necessity for a structure on the female connector corresponding to the lever on the male connector. The lever on the male connector only needs to have a simple structure specialized as a lever structure. Thus, the connectors, when fitted into each other, can be thinner in size in the fitting direction. Further, the connectors may be connected with each other in a small operation space. Moreover, since the protrusion is integral with the housing, the male connector can be fitted into the female connector even if the female connector is provided within the housing, for example. In this way, overhanging of the connectors from the housing can be minimized, thereby ensuring a mounting space for a dynamo-electric machine even when only a small space is available. The housing may be formed by aluminum diecasting, for example. Accordingly, by providing an integral protrusion, a strength of the protrusion can be ensured. Further, the lever structure for the connectors can be smaller and simpler and thus advantageous in terms of cost. Accordingly, a thinner connector connection structure can be provided that enables fitting by an insertion load reduction mechanism with a simple structure.

More preferably, the insertion assist member is supported rotatably around the fulcrum.

According to the present invention, the insertion assist member is supported rotatably around the fulcrum on the second connector (for example, a male connector) to provide a male connector with a simple structure specialized as a lever structure. Accordingly, the connectors can be thinner in size in the fitting direction when the male connector has been fitted into the first connector (for example, a female connector). Further, the connectors may be connected with each other in a small operation space. Overhanging of the connectors from the housing can be minimized, thereby ensuring a mounting space for an electric device (for example, a dynamo-electric machine) even when only a small space is available.

More preferably, the second connector is formed along a shape of the housing.

According to the present invention, since the second connector (for example, a male connector) is formed along the shape of the housing, overhanging of the connectors from the housing can be minimized when the male connector has been fitted into the first connector (for example, a female connector). Thus, a mounting space for an electric device (for example, a dynamo-electric machine) can be ensured even when only a small space is available.

More preferably, the second connector is L-shaped.

According to the present invention, since the second connector (for example, a male connector) is L-shaped, overhanging of the connectors from the housing can be minimized when the male connector has been fitted into the first connector (for example, a female connector). Thus, a mounting space for an electric device (for example, a dynamo-electric machine) can be ensured even when only a small space is available.

More preferably, the restriction element is a protrusion provided on the housing and formed in a position for the one end.

According to the present invention, the restriction element includes a protrusion provided on the housing and formed in a position for the one end of the insertion assist member (for example, a lever rotatably supported on the male connector). Thus, with the position of one end of the lever being restricted, a rotation force is applied to the other end where the protrusion is the fulcrum, thereby generating the force not smaller than a predetermined amount for the second connector (for example, a male connector). This eliminates the necessity for a structure on the first connector (for example, a female connector) corresponding to the lever on the male connector, such that the connectors can be thinner in the fitting direction. The housing is formed by aluminum diecasting, for example. Thus, by providing a protrusion integral with the housing, a strength of the protrusion can be ensured.

More preferably, the restriction element is an opening provided on the housing into which the one end can be inserted.

According to the present invention, the restriction element includes an opening provided on the housing into which the one end of the insertion assist member (for example, a lever rotatably supported on the male connector) can be inserted. Thus, with the position of one end of the lever being restricted, a rotation force is applied to the other end where the opening is the fulcrum, thereby generating the force not smaller than a predetermined amount for the second connector (for example, a male connector). This eliminates the necessity for a structure on the first connector (for example, a female connector) corresponding to the lever on the male connector, such that the connectors can be thinner in the fitting direction. The housing is formed by aluminum diecasting, for example. Accordingly, by providing an opening integral with the housing, a strength of the opening can be ensured.

More preferably, the mechanism includes a rod-like insertion assist member in the second connector whose one end's position is restricted. The insertion assist member has a groove at a predetermined angle with respect to the insertion direction of the second connector. A protrusion slidable in the groove is fixed to the housing. The insertion assist member generates the force not smaller than a predetermined amount by the protrusion sliding along the groove.

According to the present invention, the mechanism includes a rod-like insertion assist member (for example, a slide mechanism) in the second connector (for example, a male connector) whose one end's position is restricted. The slide mechanism has a groove at a predetermined angle with respect to the insertion direction of the male connector. A protrusion slidable in the groove is fixed to the housing. The slide mechanism generates the force not smaller than a predetermined amount by the protrusion sliding along the groove. This eliminates the necessity for a structure on the first connector (for example, a female connector) corresponding to the slide mechanism on the male connector. Accordingly, the connectors, when fitted into each other, can be thinner in size in the fitting direction. Further, the connectors may be connected with each other in a small operation space. Moreover, by providing a protrusion integral with the housing, the male connector can be fitted into the female connector even if the female connector is provided within the housing, for example. In this way, overhanging of the connectors from the housing can be minimized, thereby ensuring a mounting space for a dynamo-electric machine even when only a small space is available. The housing is formed by aluminum diecasting, for example. Accordingly, by providing an integral protrusion, a strength of the protrusion can be ensured. Further, the structure of the slide mechanism for the connectors can be smaller and simpler and thus advantageous in terms of cost. Accordingly, a thinner connector connection structure can be provided that enables fitting by an insertion load reduction mechanism with a simple structure.

More preferably, the other end of the insertion assist member is fixed to the housing after the second connector has been fitted into the first connector.

According to the present invention, the other end of the insertion assist member is fixed to the housing after the second connector (for example, a male connector) has been fitted into the first connector (for example, a female connector). For example, the other end of the insertion assist member is shaped so as to restrict the position of the male connector or the cables connected to the male connector. Since the other end of the insertion assist member is fixed to the housing, the insertion assist member can function as a clamp. Since the insertion assist member also serves as a clamp, the number of parts can be reduced. Further, the number of steps can be reduced since no clamp is to be attached. Thus, cost can be reduced.

A connector connection structure according to another aspect of the present invention is a connector connection structure including: a first connector on a housing accommodating an electric device mounted in a vehicle; a second connector shaped so as to be fitted into the first connector by inserting it with a force not smaller than a predetermined amount; and a rod-like insertion assist member connected, via a fulcrum, with an insertion assist mechanism for fitting the second connector into the first connector. The insertion assist member generates the force not smaller than a predetermined amount for the second connector by applying, with its one end's position being restricted, a rotation force to the other end. The second connector includes a contact joinable with a contact of the first connector to be electrically connected. The housing includes a restriction element for restricting the position of the one end.

According to the present invention, the connector connection structure is a connector connection structure including: a first connector (for example, a female connector) on a housing accommodating an electric device (for example, a dynamo-electric machine) mounted in a vehicle; a second connector (for example, a male connector) shaped so as to be fitted into the female connector by inserting it with a force not smaller than a predetermined amount; and a rod-like insertion assist member (for example, a lever rotatably supported on an insertion assist mechanism) connected, via a fulcrum, with an insertion assist mechanism (for example, an insertion jig) for fitting the male connector into the female connector. The lever generates the force not smaller than a predetermined amount for the male connector by applying, with its one end's position being restricted, a rotation force to the other end. The male connector includes a contact joinable with a contact of the female connector to be electrically connected. The housing includes a restriction element (for example, a protrusion provided on the housing and formed in a position for the one end) for restricting the position of the one end. This eliminates the necessity for a lever structure for the male and female connectors because an insertion jig is used to fit the male connector into the female connector. Accordingly, the connectors, when fitted into each other, can be thinner in size in the fitting direction. Further, manufacturing cost can be reduced. Moreover, since the protrusion is integral with the housing, the male connector can be fitted into the female connector even if the female connector is provided within the housing, for example. In this way, overhanging of the connectors from the housing can be minimized, thereby ensuring a mounting space for a dynamo-electric machine even when only a small space is available. The housing is formed by aluminum diecasting, for example. Accordingly, by providing an integral protrusion, a strength of the protrusion can be ensured. Accordingly, a thinner connector connection structure can be provided that enables fitting by an insertion load reduction mechanism with a simple structure.

Preferably, the insertion assist member is rotatably supported on the insertion assist mechanism.

According to the present invention, the insertion assist member is rotatably supported on the insertion assist mechanism (for example, an insertion jig), thereby eliminating the necessity for a lever structure on the second connector (for example, a male connector). Accordingly, the connectors, when fitted into each other, can be thinner in size in the fitting direction. Further, manufacturing cost can be reduced. Overhanging of the connectors from the housing can be minimized, thereby ensuring a mounting space for an electric device (for example, a dynamo-electric machine) even when only a small space is available.

More preferably, the second connector is formed along a shape of the housing.

According to the present invention, since the second connector (for example, a male connector) is formed along the shape of the housing, overhanging of the connectors from the housing can be minimized when the male connector has been fitted into the first connector (for example, a female connector). Thus, a mounting space for an electric device (for example, a dynamo-electric machine) can be ensured even when only a small space is available.

More preferably, the second connector is L-shaped.

According to the present invention, since the second connector (for example, a male connector) is L-shaped, overhanging of the connectors from the housing can be minimized when the male connector has been fitted into the first connector (for example, a female connector). Thus, a mounting space for an electric device (for example, a dynamo-electric machine) can be ensured even when only a small space is available.

More preferably, the restriction element is a protrusion provided on the housing and formed in a position for the one end.

According to the present invention, the restriction element includes a protrusion provided on the housing and formed in a position for the one end of the insertion assist member (for example, a lever rotatably supported on an insertion jig). Thus, with the position of one end of the lever being restricted, a rotation force is applied to the other end where the protrusion is the fulcrum, thereby generating the force not smaller than a predetermined amount for the second connector (for example, a male connector). This eliminates the necessity for a lever structure on the first connector (for example, a female connector) and the male connector, such that the connectors can be thinner in the fitting direction. The housing is formed by aluminum diecasting, for example. Accordingly, by providing a protrusion integral with the housing, a strength of the protrusion can be ensured.

More preferably, the restriction element is an opening provided on the housing into which the one end can be inserted.

According to the present invention, the restriction element includes an opening provided on the housing into which the one end of the insertion assist member (for example, a lever rotatably supported on an insertion jig) can be inserted. Thus, with the position of one end of the lever being restricted, a rotation force is applied: to the other end where the opening is the fulcrum, thereby generating the force not smaller than a predetermined amount for the second connector (for example, a male connector). This eliminates the necessity for a lever structure on the first connector (for example, a female connector) and the male connector, such that the connectors can be thinner in the fitting direction. The housing is formed by aluminum diecasting, for example. Accordingly, by providing an opening integral with the housing, a strength of the opening can be ensured.

More preferably, the insertion assist mechanism has a member connected with the one end. The restriction element is a protrusion provided on the housing and formed so as to restrict the member's position.

According to the present invention, the insertion assist mechanism (for example, an insertion jig) has a member connected with one end of the insertion assist member (for example, a rotatable lever on the insertion assist mechanism). The restriction element includes a protrusion provided on the housing and formed so as to restrict the position of the member. Thus, a rotation force can be applied to the other end of the lever where the connecting point with the member whose position is restricted by the protrusion is the fulcrum, thereby generating the force not smaller than a predetermined amount for the second connector (for example, a male connector).

More preferably, the insertion assist mechanism has a member connected with the one end. The restriction element is an opening provided on the housing into which the member can be inserted.

According to the present invention, the insertion assist mechanism (for example, an insertion jig) has a member connected with one end of the insertion assist member (for example, a rotatable lever on the insertion assist mechanism). The restriction element includes an opening provided on the housing into which the member can be inserted. Thus, a rotation force can be applied to the other end of the lever where the connecting point with the member whose position is restricted by the opening is the fulcrum, thereby generating the force not smaller than a predetermined amount for the second connector (for example, a male connector).

BEST MODES FOR CARRYING OUT THE INVENTION

Figure 1:
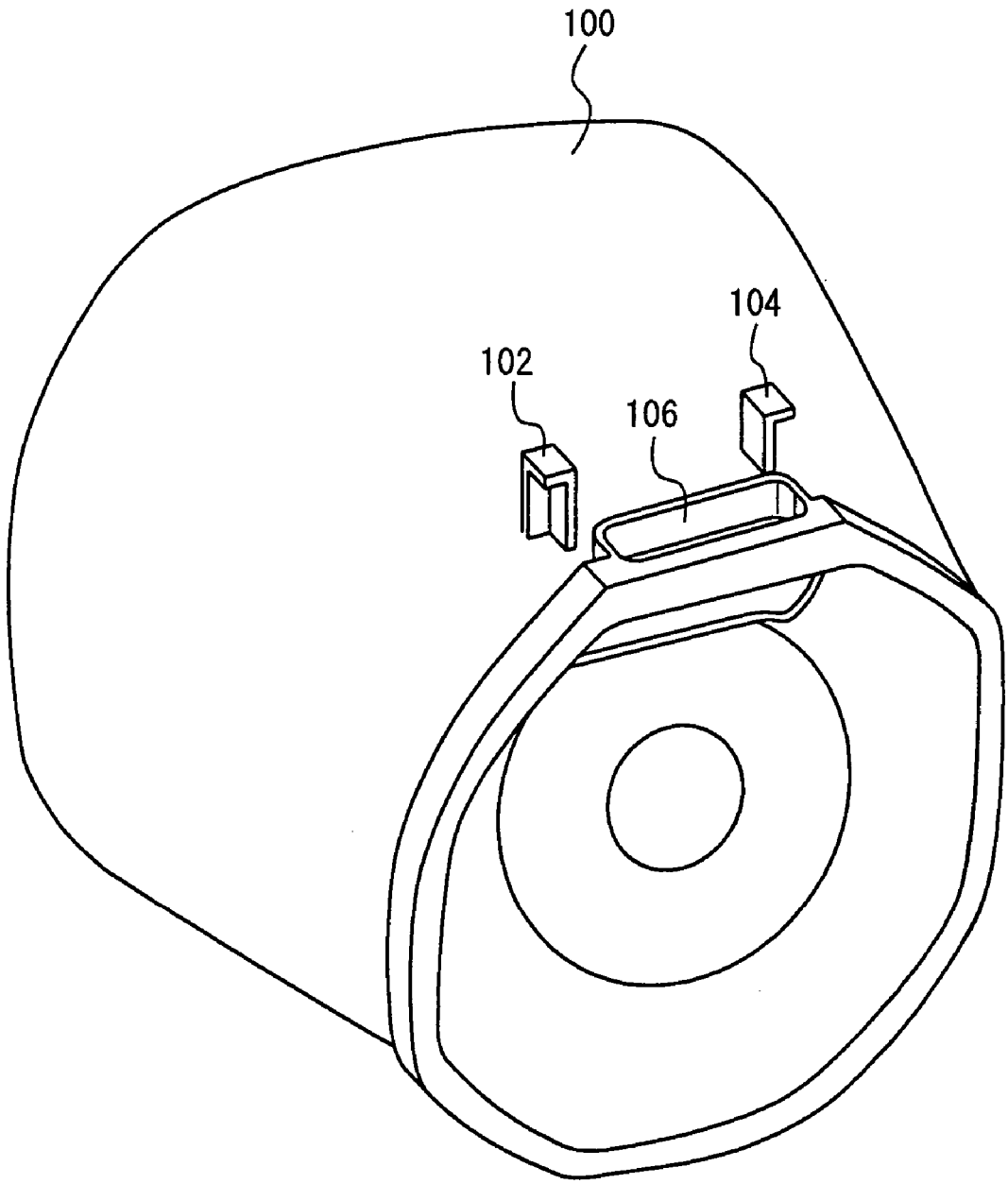
FIG. 1 is an external view of a housing for a dynamo-electric machine according to a first embodiment.

A connector connection structure according to embodiments of the present invention will now be described referring to the drawings. In the following description, like components are designated by like characters, and have the same names and functions, and thus will not be described in detail more than once.

For the connector connection structure according to the embodiments, a connector connecting a dynamo-electric machine with a cable that connects the dynamo-electric machine with an inverter will be described as an example.

First Embodiment

As shown in FIG. 1, a housing 100 accommodating a dynamo-electric machine (not shown) according to the present embodiment includes a connector insertion port 106 and protrusions 102 and 104.

The dynamo-electric machine is electrically connected with a cable by a male connector at an end of the cable being fitted into a female connector provided in connector insertion port 106 connected with the dynamo-electric machine such that the contacts within the connectors are joined together. For this purpose, a force not smaller than a predetermined amount needs to be applied in the fitting direction to the male connector fitted into connector insertion port 106. Thus, connectors with a large terminal, for example, are fitted into each other with a very high insertion load, which means low operability. In view of this, the connectors include an integral mechanism for increasing the force applied by the operator for insertion. Increasing the force applied for insertion can lead to a decrease in the insertion load applied by the operator to apply a force not smaller than a predetermined amount for connector fitting. An insertion load reduction mechanism is provided on connectors for reducing the insertion load applied by the operator. The insertion load reduction mechanism may be, for example, a lever mechanism based on the lever principle. The connector connection structure according to the present embodiment has such a lever mechanism. The lever mechanism uses protrusions 102 and 104 provided on housing 100 to help fit the male connector into the female connector. The connector connection structure according to the present embodiment will now be described in detail referring to the cross sections shown in FIGS. 2 and 3 of housing 100 accommodating a dynamo-electric machine.

Figure 2:
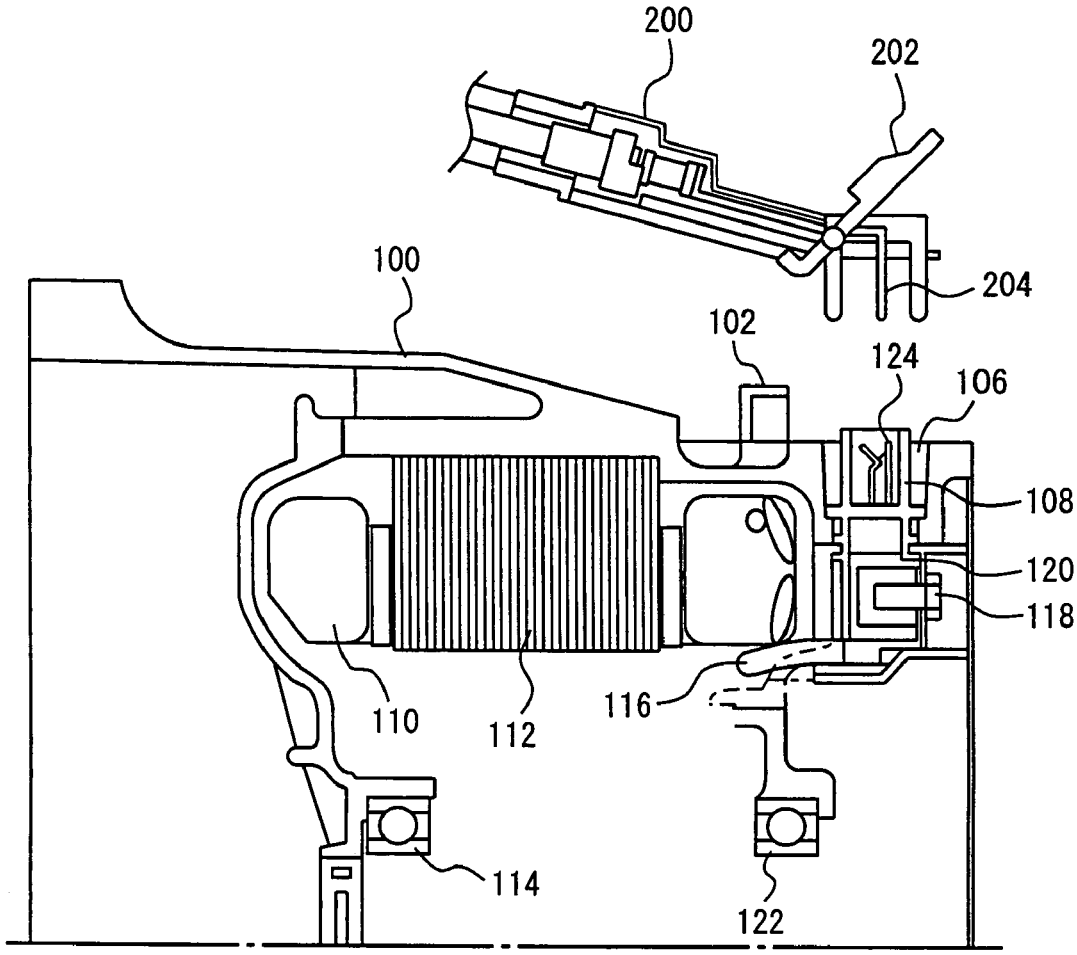
FIG. 2 is a cross sectional view of the dynamo-electric machine according to the first embodiment.

As shown in FIG. 2, housing 100 for a dynamo-electric machine according to the present embodiment accommodates a stator for the dynamo-electric machine composed of stator core 112 and a coil 110, bearings 114 and 122, a protrusion 102, a female connector 108, a terminal seat fixing member 120, a bolt 118, and a wire connection member 116.

Stator core 112 has a hollow cylindrical shape. Stator core 112 has a plurality of slots. Coil 110 is wound on the slots. Stator core 112 is fixed to housing 100 by, for example, clamping it by a bolt. The shaft of the rotor of the dynamo-electric machine, not shown, is rotatably supported on bearings 114 and 122.

The terminal seat of female connector 108 is inserted into housing 100 through connector insertion port 106 from the periphery. Terminal seat fixing member 120 is inserted into housing 100 in a direction perpendicular to the rotational axis in housing 100. Inserted terminal seat fixing member 120 is clamped by bolt 118 and fixed. Since the terminal seat of female connector 108 is fixed, the position of female connector 108 is fixed. The terminal seat of female connector 108 has electrical paths, not shown, distributed thereon. The electrical paths on the terminal seat of female connector 108 are electrically connected with wire connection member 116 connected with coil 110. Female connector 108 has a contact 124. Female connector 108 is shaped such that a male connector 200 can be fitted into it. Thus, fitting male connector 200 into it causes the contact to be joined with a contact 204 on male connector 200. In this way, the cable is electrically connected with the dynamo-electric machine via the connectors. While the connector configuration of the male and female connectors is not limited to a particular one, the present embodiment includes, for example, a concave male connector and a convex female connector.

Male connector 200 is shaped to lie along housing 100 when it has been fitted there. Accordingly, overhanging of the cable in a radial direction of the dynamo-electric machine or overhanging of the connectors from the housing can be minimized when the male connector has been fitted into the female connector. Thus, a mounting space can be ensured for a dynamo-electric machine even when only a small space is available. Or, male connector 200 may also be L-shaped to provide similar advantages.

To fit male connector 200 into female connector 108, male connector 200 is tied up with female connector 108, and one end of rotatable lever 202 on male connector 200 is hooked on protrusion 102 on housing 100. With the position of one end of lever 202 being restricted, a rotation force is applied to the other end to generate a force not smaller than a predetermined amount for male connector 200 where protrusion 102 is the fulcrum. Thus, male connector 200 is inserted and fitted into female connector 108.

Figure 3A:
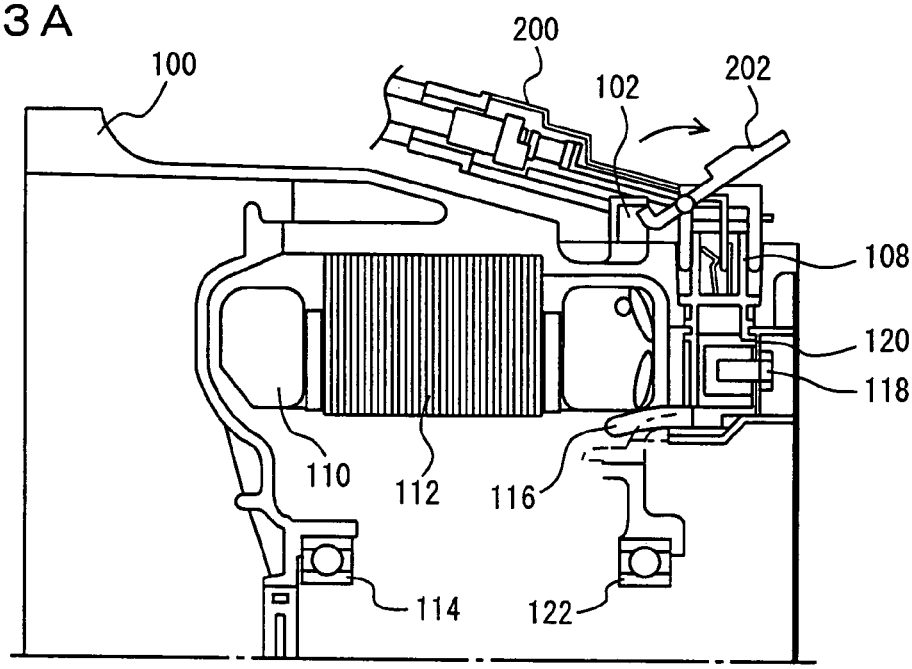
FIGS. 3A and 3B illustrate a process of tying up a male connector with a female connector connected with the dynamo-electric machine according to the first embodiment.
Figure 3B:
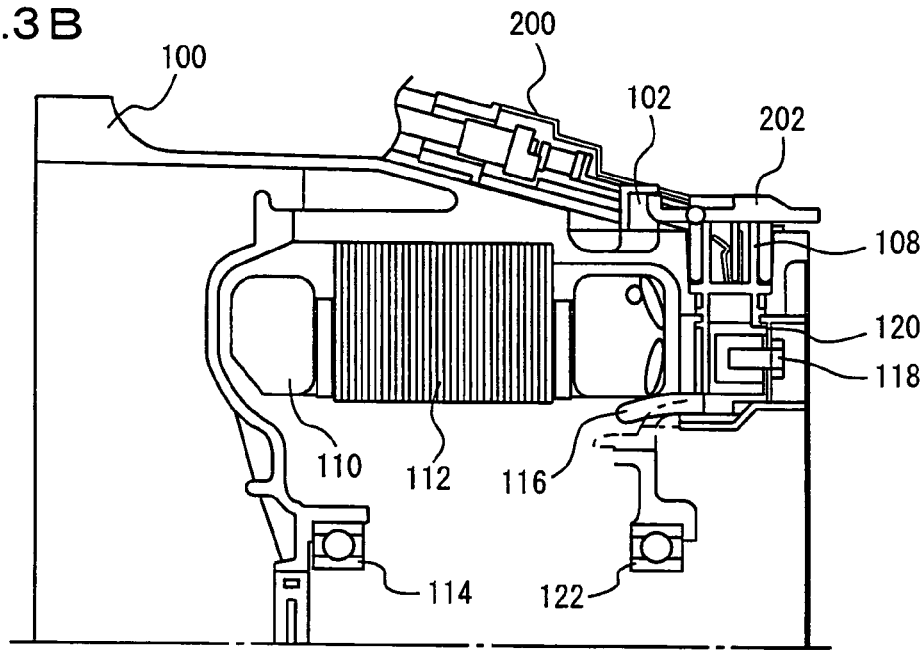

Referring to FIG. 3, a process of inserting male connector 200 into female connector 108 will be illustrated. Male connector 200 is tied up with female connector 108, as shown in FIG. 3A. One end of lever 202 rotatably supported on male connector 200 is hooked on protrusion 102. In a direction in which the one end of lever 202 is hooked on protrusion 102 (the direction of the arrow shown in FIG. 3A), a rotation force is applied to the other end of lever 202. At this time, a force not smaller than a predetermined amount is generated for male connector 200. The rotation force continues to be applied to lever 202 until it is in a position where the rotation stops, as shown in FIG. 3B. That is, male connector 200 is completely fitted into female connector 108. Based on the lever principle, male connector 200 is inserted there by a rotation force applied to the lever smaller than the insertion load for inserting male connector 200 into female connector 108. Contact 124 of female connector 108 is joined with contact 204 of male connector 204 to be electrically connected.

Protrusions 102 and 104 are formed on housing 100 in a position for the one end of lever 202. The one end of lever 202 is hooked on protrusions 102 and 104 to generate a force not smaller than a predetermined amount for fitting male connector 200 into female connector 108. However, such protrusions are a non-limitative example. For example, an opening can be provided on housing 100 into which one end of lever 202 can be inserted. That is, one end of lever 202 can be inserted into the opening and hooked on it.

As above, according to the connector connection structure of the present embodiment, the connector connection structure includes: a female connector provided on a housing accommodating a dynamo-electric machine mounted in a vehicle; and a male connector shaped so as to be fitted into the female connector by inserting it with a force not smaller than a predetermined amount. The male connector includes a contact joinable with a contact of the female connector to be electrically connected, and a lever connected with the male connector via a fulcrum, the lever being rotatably supported on the rod-like male connector. The lever generates the force not smaller than a predetermined amount by applying, with its one end's position being restricted, a rotation force to the other end. The housing includes a protrusion provided on the housing in a position for the one end to restrict the position of the one end. This eliminates the necessity for a structure on the female connector corresponding to the lever on the male connector. The lever on the male connector only needs to have a simple structure specialized as a lever structure. Thus, the connectors, when fitted into each other, can be thinner in size. Further, the connectors can be connected with each other in a small operation space. Moreover, since the protrusion is integral with the housing, the male connector can be fitted into the female connector even if the female connector is provided within the housing, for example. In this way, overhanging of the connectors from the housing can be minimized, thereby ensuring a mounting space for a dynamo-electric machine even when only a small space is available. The housing is formed by aluminum diecasting, for example. Thus, by providing an integral protrusion, a strength of the protrusion can be ensured. Moreover, the lever structure provided on the connectors can be smaller and simpler and thus advantageous in terms of cost. Accordingly, a thinner connector connection structure can be provided that enables fitting by an insertion load reduction mechanism with a simple structure.

Second Embodiment

A connector connection structure according to a second embodiment will now be described.

Figure 4:
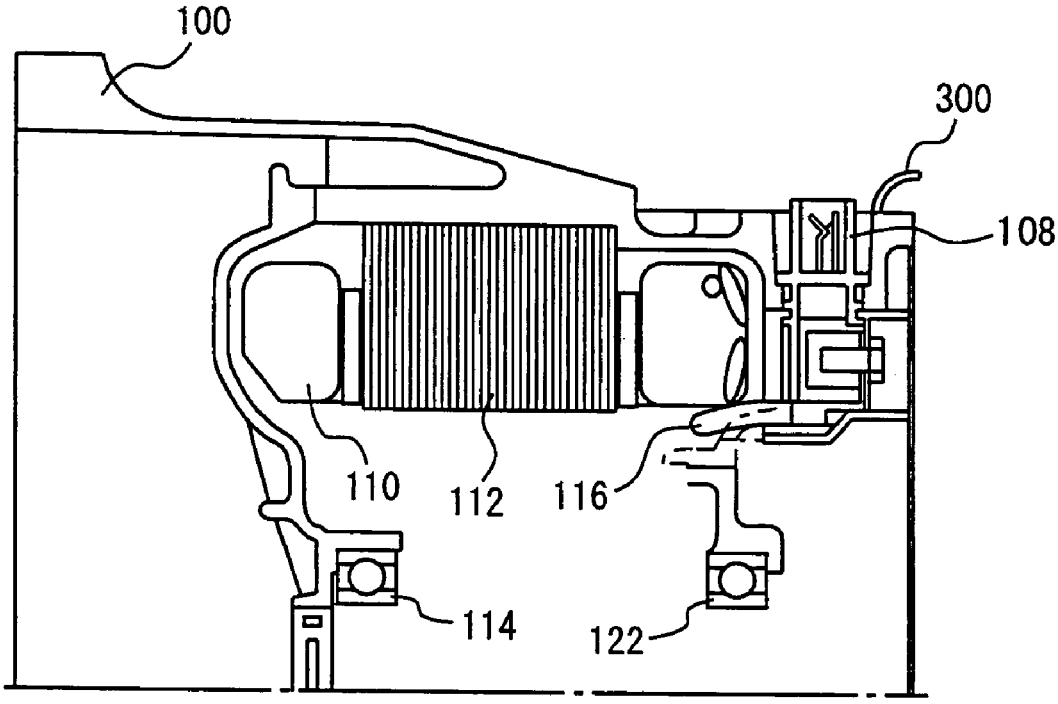
FIG. 4 is a cross-sectional view of a dynamo-electric machine according to a second embodiment.

Referring to FIG. 4, the connector connection structure of the present embodiment is different from that of the first embodiment in that it includes a protrusion 300 instead of protrusion 102 in the structure of the dynamo-electric machine of the first embodiment, and that lever 202 is not necessary on male connector 200. The other elements of the structure are the same as in the first embodiment. They are designated by the same reference characters and have the same functions and thus will not be described in detail again.

As shown in FIG. 4, a protrusion 300 is provided on the periphery of connector insertion port 106 of housing 100. In the present embodiment, male connector 200 is fitted into female connector 108 by using protrusion 300 utilizing an insertion jig (not shown) as an insertion assist mechanism.

Figure 5A:
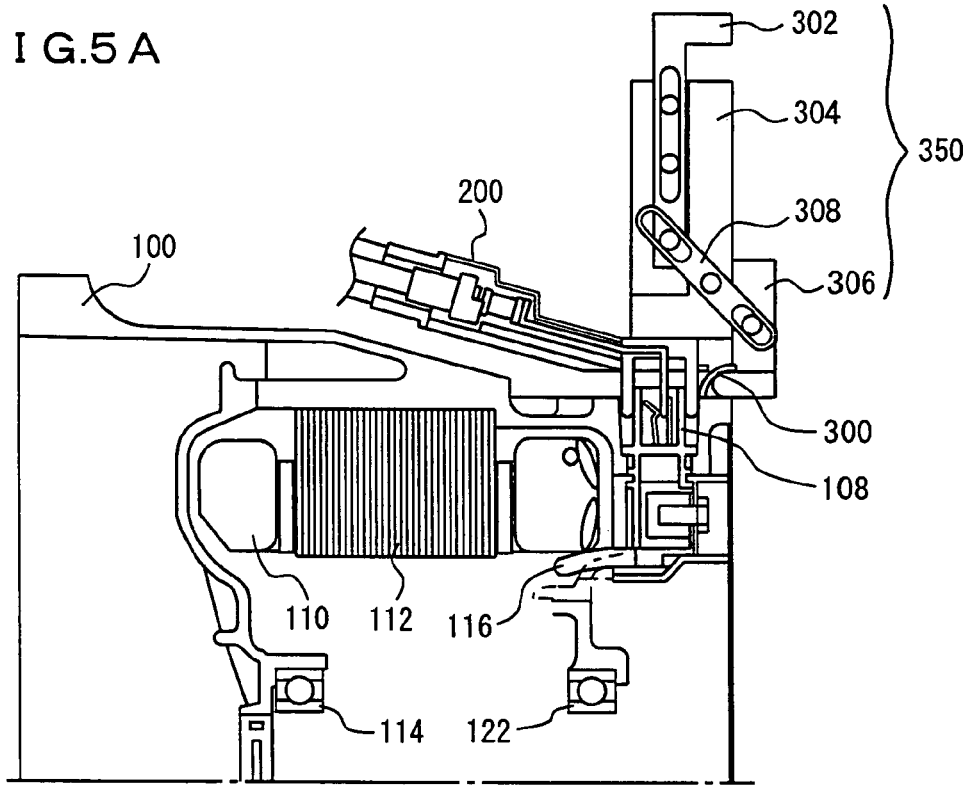
FIGS. 5A and 5B illustrate a process of tying up a male connector with a female connector connected with the dynamo-electric machine according to the second embodiment.

Referring to FIG. 5, a process of inserting male connector 200 into female connector 108 will be illustrated. Male connector 200 is tied up with female connector 108, as shown in FIG. 5A. At this time, an insertion jig 350 is brought into contact with male connector 200.

Insertion jig 350 includes: an insertion jig member 304 contactable with male connector 200; an insertion jig member 302 provided on insertion jig member 304 and movable in a direction parallel to the insertion direction; an insertion jig member 306 whose movement in the insertion direction is restricted by protrusion 300 on housing 100; and a lever 308 rotatably supported on insertion jig member 308 and connected with an end of insertion jig member 302 and with insertion jig member 306.

Figure 5B:
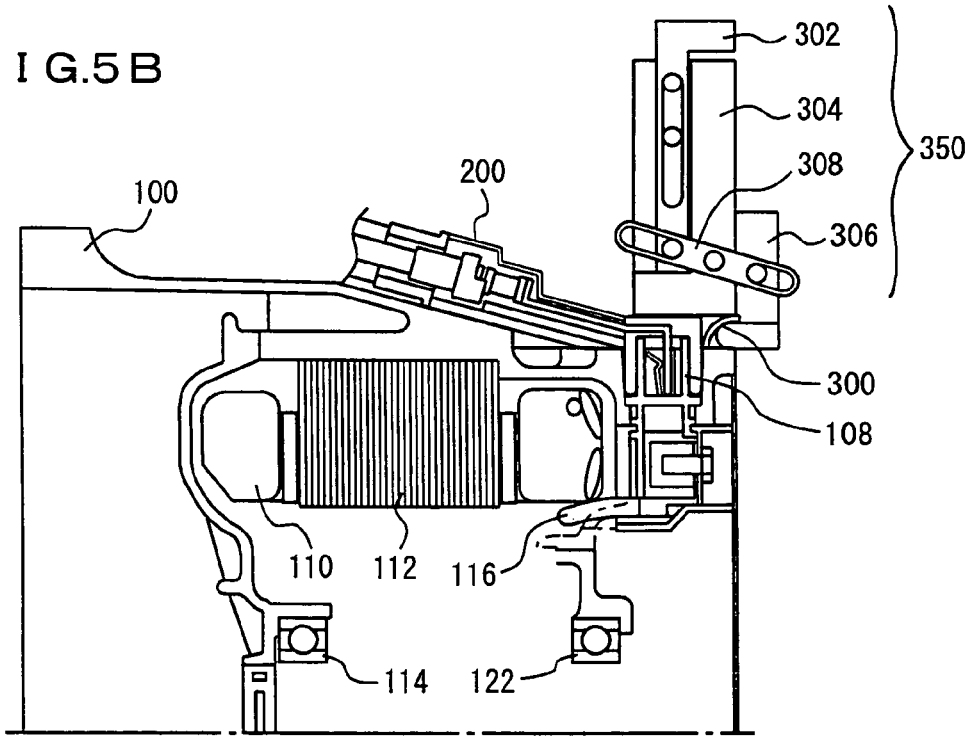

In insertion jig 350, an end of insertion jig member 306 is tied up with protrusion 300 such that its movement in the insertion direction is restricted. At this time, the movement of one end of lever 308 is restricted by insertion jig member 306. Then, a force in the insertion direction of male connector 200 is applied to insertion jig member 302 to apply a rotation force to the other end of lever 308. At this time, lever 308 generates a force not smaller than a predetermined amount where its one end connected with insertion jig member 306 is the fulcrum. This force not smaller than a predetermined amount causes male connector 200 to be fitted into female connector 108. Insertion jig member 302 is pushed into insertion jig member 304 until it comes to a contacting position, as shown in FIG. 5B. Based on the lever principle, male connector 200 is inserted there by pushing insertion jig member 302 by a force smaller than the insertion load for inserting male connector 200 into female connector 108. After male connector 200 is completely fitted into female connector 108, insertion jig 350 is removed.

Protrusion 300 is formed on housing 100 in a position for insertion jig member 306 to which one end of lever 308 is connected. Thus, insertion jig member 306 is hooked on protrusion 300 to generate a force not smaller than a predetermined amount for fitting male connector 200 into female connector 108. However, such a protrusion is a non-limitative example. For example, an opening can be provided on housing 100 into which an end of insertion jig member 306 can be inserted.

Further, in the present embodiment, the structure of insertion jig 350 is not limited to a particular one. For example, one end of a lever in a lever structure of insertion jig 350 is hooked on a protrusion or an opening provided on the housing to restrict its position and a rotation force is applied to the other end where the protrusion or the opening serves as the fulcrum to generate a force not smaller than a predetermined amount for male connector 200.

As above, according to the connector connection structure of the present embodiment, the connector connection structure includes: a female connector provided on a housing accommodating a dynamo-electric machine mounted in a vehicle; a male connector shaped so as to be fitted into the female connector by inserting it with a force not smaller than a predetermined amount; and a lever connected, via a fulcrum, with an insertion jig for fitting the male connector into the female connector, the lever rotatably supported on the rod-like insertion jig. The lever generates the force not smaller than a predetermined amount for the male connector by applying, with its one end's position being restricted, a rotation force to the other end. The male connector includes a contact joinable with a contact of the female connector to be electrically connected. The housing includes a protrusion provided on the housing in a position for the one end for restricting the position of the one end. Thus, the insertion jig is used to fit the male connector into the female connector, eliminating the necessity for a lever structure on the male and female connectors. Thus, the connectors, when fitted into each other, can be thinner in size in the fitting direction. Further, manufacturing cost can be reduced. Moreover, since a protrusion is integral with the housing, the male connector can be fitted into the female connector even if the latter is provided within the housing, for example. In this way, overhanging of the connectors from the housing can be minimized, thereby ensuring a mounting space for a dynamo-electric machine even when only a small space is available. The housing is formed by aluminum diecasting, for example. Thus, by providing an integral protrusion, a strength of the protrusion can be ensured. Accordingly, a thinner connector connection structure can be provided that enables fitting by an insertion load reduction mechanism with a simple structure.

Third Embodiment

A connector connection structure according to a third embodiment will now be described.

The connector connection structure according to the present embodiment is similar to the arrangement of the connector connection structure of the first embodiment except for the configuration of male connector 200 and that protrusions 102 and 104 provided on housing 100 are replaced by protrusions 426 and 428 that are different from protrusion 102 and 104 in position and in shape. The similar elements are designated by the same reference characters and have the same functions, and thus will not be described in detail again.

Figure 6:
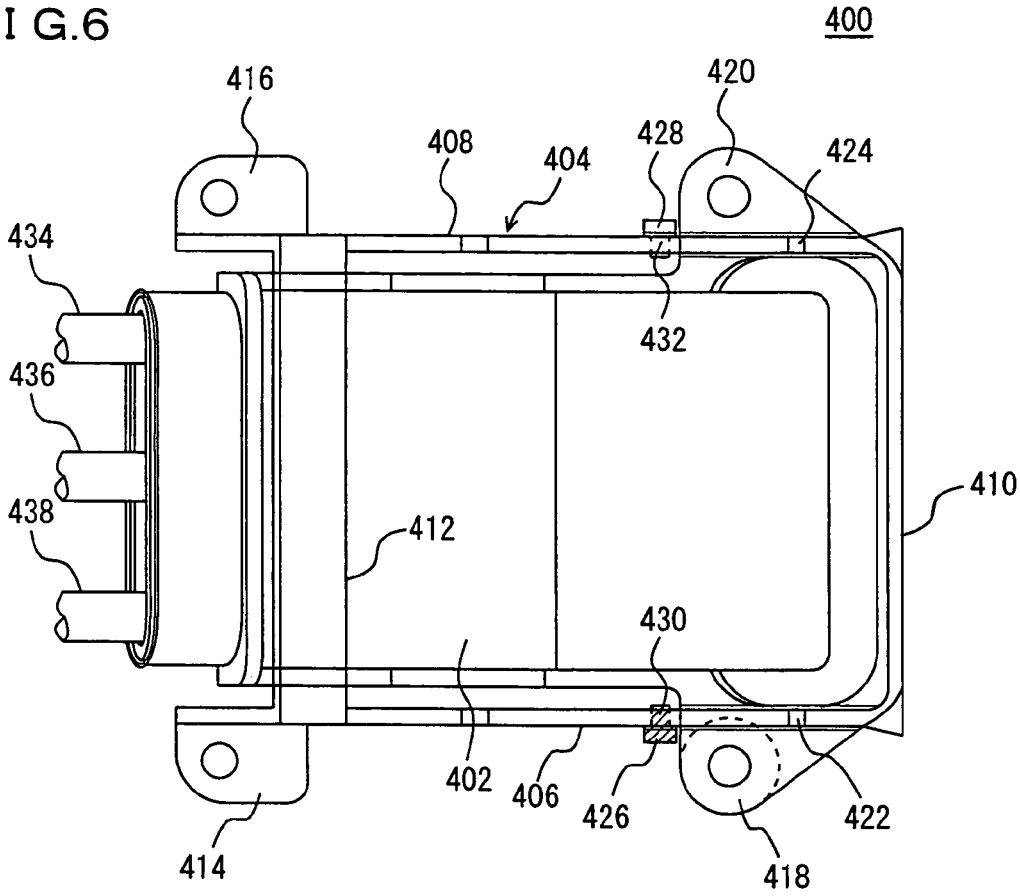
FIG. 6 is an external view of a connector structure according to a third embodiment.
Figure 7:
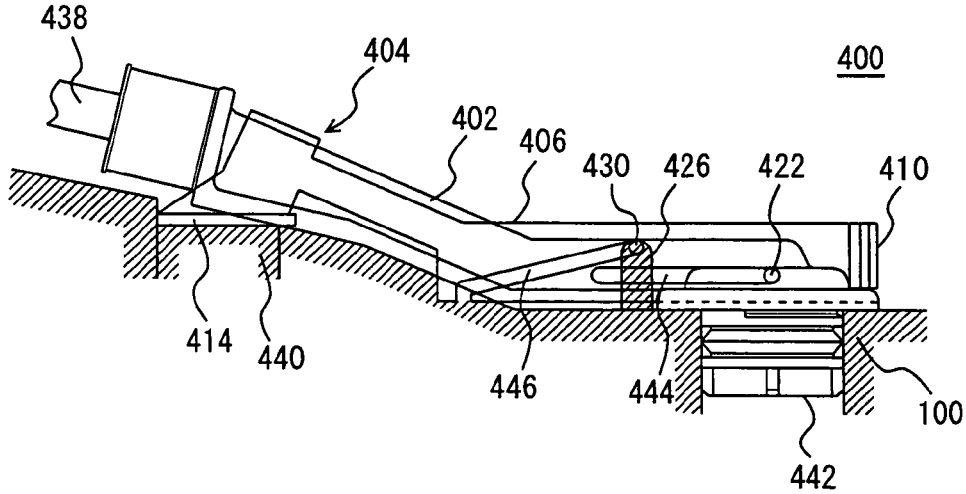
FIG. 7 is a side view of the connector structure according to the third embodiment.

As shown in FIGS. 6 and 7, a male connector 400 of the present embodiment includes a shield shell 402, a slide mechanism 404, a connector element 442, and cables 434, 436 and 438.

Shield shell 402 is shaped to cover the contact region. Bearing surfaces 420 and 418 through which bolts are passed are provided on shield shell 402 close to the contact region. Connector element 442 is provided on shield shell 402. Connector element 442 is inserted through connector insertion port 106 of housing 100. Connector element 442 is shaped so as to be fitted into female connector 108.

Slide mechanism 404 includes a member (1) 406 and a member (2) 408 parallel to each other, as well as a member (3) 410 and a member (4) 412 connecting member (1) 406 with member (2) 408.

Member (1) 406 and member (2) 408 have shield shell 402 sandwiched between them in the width direction of shield shell 402. A groove 444 with a predetermined length is provided on one end of each of member (1) 406 and member (2) 408. Pins 422 and 424 are provided on shield shell 402 facing the outside in its width direction. Slide mechanism 404 is provided such that pins 422 and 424 slide along groove 444. Thus, slide mechanism 404 is slidable by the length of groove 444 with respect to shield shell 402. One end of member (1) 406 is connected with that of member (2) 408 by member (3) 410.

Bearing surfaces 414 and 416 through which bolts are passed are provided on the other ends of member (1) 406 and member (2) 408, respectively. Bearing surface 414 is shaped so as to abut a bearing surface on protrusion 440 on housing 100 after male connector 400 has been fitted into female connector 108. Member (4) 412 straddles shield shell 402 to connect the other end of member (1) 406 with that of member (2) 408.

A groove 446 is provided on each of member (1) 406 and member (2) 408 at a predetermined angle with respect to the insertion direction of male connector 400. Groove 446 has an opening with respect to the insertion direction of male connector 400. Protrusions 426 and 428 are provided on the periphery of connector insertion port 106 of housing 100. Pins 430 and 432 are provided at the tip ends of protrusions 426, 428, respectively, and opposite each other.

Figure 8:
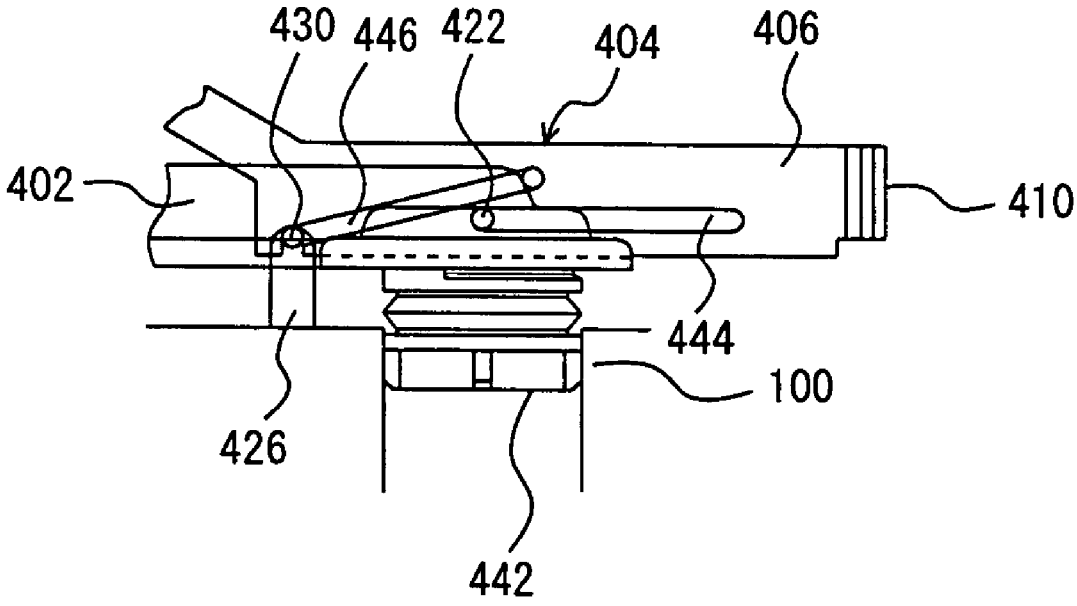
FIG. 8 illustrates a process of tying up a male connector with a housing according to the third embodiment.

In the present embodiment, male connector 400 is fitted into female connector 108 using slide mechanism 404 as an insertion assist member. As shown in FIG. 8, fitting is performed by sliding pins 430 and 432 of protrusions 426 and 428 along groove 446 from the opening of groove 446.

For this purpose, a force is applied to member (3) 410 in a direction perpendicular to the insertion direction of male connector 400 and in the longitudinal direction of groove 444 to generate a force not smaller than a predetermined amount for slide mechanism 404 in the insertion direction of male connector 400.

Specifically, when a force is applied to member (3) 410, slide mechanism 404 is moved in a direction as pins 430 and 432 slide along groove 446. The position of slide mechanism 404 in the insertion direction of male connector 400 is restricted by pins 422 and 424. At this time, member (3) 410 provides an effort point, pins 430 and 432 serve as fulcrums and pins 422 and 424 provide points of action. Thus, a force in the insertion direction acts upon shield shell 402 based on the lever principle. As a result, a force not smaller than a predetermined amount is generated for male connector 400 for fitting male connector 400 into female connector 108.

After male connector 400 has been fitted into female connector 108, shield shell 402 can be fixed to housing 100 by clamping bolts through bearing surfaces 414, 416, 418 and 420 to bearing surfaces of housing 100.

At this time, bearing surfaces 414 and 416 on the other ends of member (1) 406 and member (2) 408 abut bearing surfaces of protrusions 440 on housing 100. Thus, the other ends of member (1) 406 and member (2) 408 are clamped to housing 100 through bolts to restrict the position of shield shell 402 using slide mechanism 404. That is, slide mechanism 404 can function as a clamp for male connector 400. For example, member (4) 412 is provided such that an internal force is produced in a direction that causes member (4) 412 to press shield shell 402 to housing 100 when the other ends of member (1) 406 and member (2) 408 are fixed to housing 100. Thus, the position of shield shell 402 in the area of the cables can be restricted. It should be noted that member (4) 412 may also be adapted to restrict the position of cables 434, 436 and 438.

As above, according to the connector connection structure of the present embodiment, the mechanism includes a slide mechanism on the male connector with its one end's position being restricted. The slide mechanism has a groove at a predetermined angle with respect to the insertion direction of the male connector. A protrusion slidable along the groove is fixed to the housing. The slide mechanism generates a force not smaller than a predetermined amount by the protrusion sliding along the groove. This eliminates the necessity for a structure on the female connector corresponding to the slide structure on the male connector. Thus, the connectors, when fitted into each other, can be thinner in size in the fitting direction. Further, the connectors can be connected with each other in a small operation space. Moreover, since the protrusion is integral with the housing, the male connector can be fitted into the female connector even if the latter is provided within the housing, for example.

In this way, overhanging of the connectors from the housing can be minimized, thereby ensuring a mounting space for a dynamo-electric machine even when only a small space is available. The housing is formed by aluminum diecasting, for example. Thus, by providing an integral protrusion, a strength of the protrusion can be ensured. Moreover, the lever structure provided on the connectors can be smaller and simpler and thus advantageous in terms of cost. Accordingly, a thinner connector connection structure can be provided that enables fitting by an insertion load reduction mechanism with a simple structure.

After the male connector has been fitted into the female connector, the other end of the slide mechanism is fixed to the housing. The other end of the slide mechanism is shaped so as to restrict the position of the male connector or the cables connected to the male connector. Since the other end of the slide mechanism is fixed to the housing, the slide mechanism can function as a clamp. Since the slide mechanism also serves as a clamp, the number of parts can be reduced. Further, the number of steps can be reduced since no clamp is to be attached. Thus, cost can be reduced.

Fourth Embodiment

A connector connection structure according to a fourth embodiment will now be described.

The connector connection structure of the present embodiment is similar to the arrangement of the connector connection structure of the third embodiment except that male connector 400 includes a lever mechanism 404 instead of slide mechanism 404 and that protrusions 426 and 428 on housing 100 are replaced by protrusions 526 and 528 that are different from protrusions 426 and 428 in position and in shape. The same elements are designated by the same reference characters and have the same functions, and thus will not be described in detail again.

Figure 9:
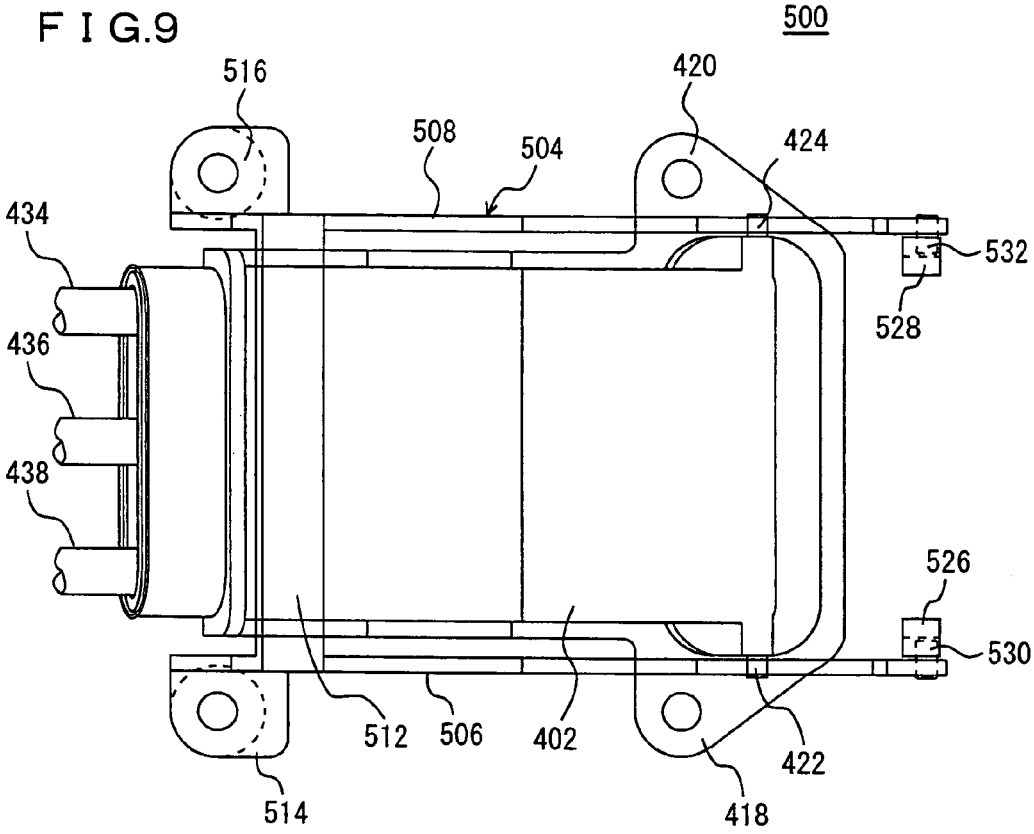
FIG. 9 is an external view of a connector structure according to a fourth embodiment.
Figure 10:
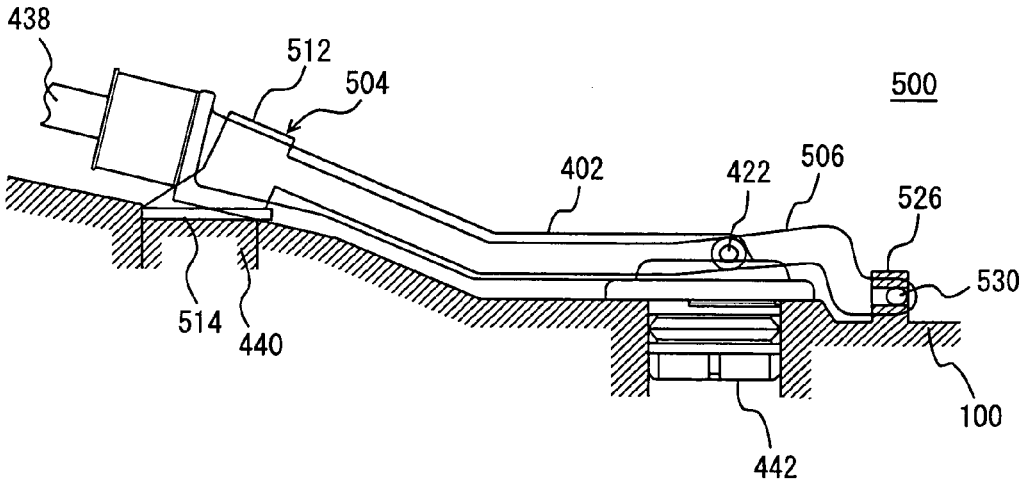
FIG. 10 is a side view of the connector structure according to the fourth embodiment.

As shown in FIGS. 9 and 10, a male connector 500 of the present embodiment includes a lever mechanism 504. Lever mechanism 504 is composed of a member (5) 506 and a member (6) 508 parallel to each other as well as a member (7) 512 connected with member (5) 506 and member (6) 508.

Member (5) 506 and member (6) 508 have shield shell 402 sandwiched between them in the width direction of shield shell 402. Member (5) 506 and member (6) 508 are rotatably supported by pins 422 and 424, respectively, provided on shield shell 402. Pins 530 and 532 are provided on one end of member (5) 506 and member (6) 508, respectively.

Bearing surfaces 514 and 516 through which bolts are passed are provided on the other ends of member (5) 506 and member (6) 508. Member (7) 512 straddles shield shell 402 to connect the other end of member (5) 506 with that of member (6) 508.

Protrusions 526 and 528 are provided on housing 100. Protrusions 526 and 528 are adapted to restrict the position of one end of member (5) 506 and member (6) 508. For example, a groove is provided on each of protrusions 526 and 528. Pins 530 and 532 provided on the one end of member (5) 506 and member (6) 508 are slid along the groove. At this time, the position of the one end of member (5) 506 and member (6) 508 is restricted in the insertion direction of male connector 500.

Figure 11:
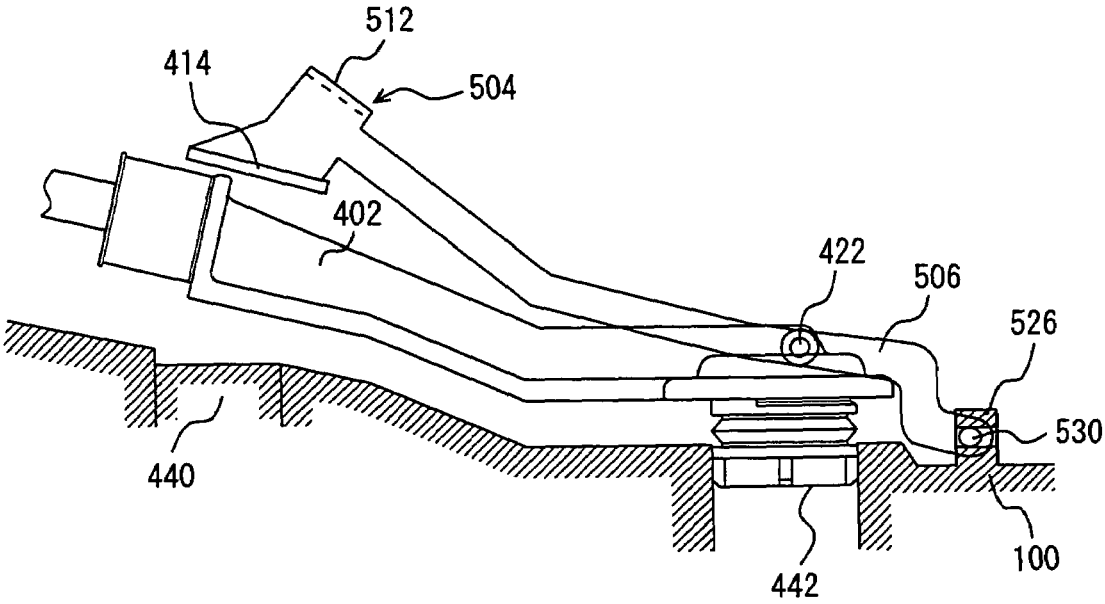
FIG. 11 illustrates a process of tying up a male connector with a housing according to the fourth embodiment.

In the present embodiment, male connector 500 is fitted into female connector 108 by using lever mechanism 504 as an insertion assist member. Specifically, as shown in FIG. 11, pins 530 and 532 of member (5) 506 and member (6) 508 are slid along the grooves of protrusions 526 and 528 on housing 100. At this time, a rotation force is applied to member (7) 512 such that lever mechanism 504 is rotated about pins 422 and 424. Since the position of the one end of member (5) 506 and member (6) 508 is restricted by the grooves of protrusions 526 and 528, a force not smaller than a predetermined amount in the insertion direction is generated for pins 422 and 424 based on the lever principle.

After male connector 500 has been fitted into female connector 108, shield shell 402 can be fixed to housing 100 by clamping bolts through bearing surfaces 514, 516, 418 and 420 to bearing surfaces provided on housing 100.

At this time, bearing surfaces 514 and 516 provided on the other end of member (5) 506 and member (6) 508 abut bearing surfaces of protrusions 440 on housing 100. Accordingly, by clamping the other end of member (5) 506 and member (6) 508 to housing 100 through bolts, the position of shield shell 402 can be restricted by lever mechanism 504. That is, lever mechanism 504 can function as a clamp for male connector 500. For example, member (7) 512 is provided such that an internal force is produced in a direction that causes member (7) 512 to press shield shell 402 to housing 100 when the other end of member (5) 506 and member (6) 508 is fixed to housing 100. Thus, the position of shield shell 402 in the area of the cables can be restricted. It should be noted that member (7) 512 may also be adapted to restrict the position of cables 434, 436 and 438.

The operability during the rotation can be improved by providing member (7) 512 with a flat portion. Further, since lever mechanism 504 is fixed to the housing, it can work as conductor for the shield. This can lead to, for example, a reduction in noise.

As above, according to the connector connection structure of the present embodiment, in addition to the advantages provided by the connector connection structure of the first embodiment, the other end of the lever mechanism is fixed to the housing after the male connector has been fitted into the female connector. The other end of the lever mechanism is shaped so as to restrict the position of the male connector or the cables connected to the male connector. Since the other end of the lever mechanism is fixed to the housing, the lever mechanism can function as a clamp. Since the lever mechanism also works as a clamp, the number of parts can be reduced. Further, the number of steps can be reduced since no clamp is to be attached. Thus, cost can be reduced.

It should be understood that the disclosed embodiments above are, in all respects, by way of illustration only and not by way of limitation. The scope of the present invention is set forth by the claims rather than the above description and is intended to cover all the modifications within a spirit and scope equivalent to those of the claims.

The invention claimed is:

1. A connector connection structure comprising: a first connector on a housing accommodating an electric device mounted in a vehicle; and a second connector shaped so as to be fitted into said first connector by inserting it with a force not smaller than a predetermined amount, wherein said second connector has a contact joinable with a contact of said first connector to be electrically connected, said second connector includes a mechanism that is integral therewith for increasing a force applied by an operator for insertion, said mechanism includes a rod-like insertion assist member in said second connector whose one end position is restricted, said rod-like insertion assist member has a groove at a predetermined angle with respect to an insertion direction of said second connector, a protrusion slidable in a said groove is fixed to said housing, and said rod-like insertion assist member generates said force not smaller than a predetermined amount by said protrusion sliding along said groove.

2. The connector connection structure according to claim 1, wherein said second connector is formed along a shape of said housing.

3. The connector connection structure according to claim 1, wherein said second connector is L-shaped.

4. The connector connection structure according to claim 1, wherein said rod-like insertion assist member is connected to said second connector via a fulcrum, said rod-like insertion assist member generates said force not smaller than a predetermined amount by applying, with its one end's position being restricted, a rotation force to another end, and said housing includes a restriction means for restricting the position of said one end.

5. The connector connection structure according to claim 4, wherein said rod-like insertion assist member is supported rotatably about said fulcrum.

6. The connector connection structure according to claim 4, wherein said restriction means is a protrusion provided on said housing and formed in a position for said one end.

7. The connector connection structure according to claim 4, wherein said restriction means is an opening provided on said housing into which said one end can be inserted.

8. The connector connection structure according to claim 4, wherein another end of said rod-like insertion assist member is fixed to said housing after said second connector has been fitted into said first connector.

9. The connector connection structure according to claim 1, wherein said rod-like insertion assist member is connected with said second connector via a fulcrum, said rod-like insertion assist member generates said force not smaller than a predetermined amount by applying, with its one end's position being restricted, a rotation force to another end, and said housing includes a restriction element for restricting the position of said one end.

10. The connector connection structure according to claim 9, wherein said rod-like insertion assist member is supported rotatably about said fulcrum.

11. The connector connection structure according to claim 9, wherein said restriction element is a protrusion provided on said housing and formed in a position for said one end.

12. The connector connection structure according to claim 9, wherein said restriction element is an opening provided on said housing into which said one end can be inserted.

13. The connector connection structure according to claim 9, wherein another end of said rod-like insertion assist member is fixed to said housing after said second connector has been fitted into said first connector.

14. A connector connection structure comprising: a first connector on a housing accommodating an electric device mounted in a vehicle; a second connector shaped so as to be fitted into said first connector by inserting it with a force not smaller than a predetermined amount; and a rod-like insertion assist member connected, via a fulcrum, with an insertion assist mechanism for fitting said second connector into said first connector, wherein said rod-like insertion assist member generates said force not smaller than a predetermined amount for said second connector by applying, with its one end's position being restricted, a rotation force to another end, said second connector includes a contact joinable with a contact of said first connector to be electrically connected, said housing includes a restriction means for restricting the position of said one end, said insertion assist mechanism has a member connected with said one end, and said restriction means is an opening provided on said housing into which said member can be inserted.

15. The connector connection structure according to claim 14, wherein said rod-like insertion assist member is rotatably supported on said insertion assist mechanism.

16. The connector connection structure according to claim 14, wherein said second connector is formed along a shape of said housing.

17. The connector connection structure according to claim 14, wherein said second connector is L-shaped.

18. The connector connection structure according to claim 14, wherein said restriction means is a protrusion provided on said housing and formed in a position for said one end.

19. The connector connection structure according to claim 14, wherein said restriction means is an opening provided on said housing into which said one end can be inserted.

20. The connector connection structure according to claim 14, wherein said insertion assist mechanism has a member connected with said one end, and said restriction means is a protrusion provided on said housing and formed so as to restrict said member's position.

21. A connector connection structure comprising: a first connector on a housing accommodating an electric device mounted in a vehicle; a second connector shaped so as to be fitted into said first connector by inserting it with a force not smaller than a predetermined amount; and a rod-like insertion assist member connected, via a fulcrum, with an insertion assist mechanism for fitting said second connector into said first connector, wherein said rod-like insertion assist member generates said force not smaller than a predetermined amount for said second connector by applying, with its one end's position being restricted, a rotation force to another end, said second connector includes a contact joinable with a contact of said first connector to be electrically connected, said housing includes a restriction element for restricting the position of said one end, said insertion assist mechanism has a member connected with said one end, and said restriction element is an opening provided on said housing into which said member can be inserted.

22. The connector connection structure according to claim 21, wherein said rod-like insertion assist member is rotatably supported on said insertion assist mechanism.

23. The connector connection structure according to claim 21, wherein said second connector is formed along a shape of said housing.

24. The connector connection structure according to claim 21, wherein said second connector is L-shaped.

25. The connector connection structure according to claim 21, wherein said restriction element is a protrusion provided on said housing and formed in a position for said one end.

26. The connector connection structure according to claim 21, wherein said restriction element is an opening provided on said housing into which said one end can be inserted.

27. The connector connection structure according to claim 21, wherein said insertion assist mechanism has a member connected with said one end, and said restriction element is a protrusion provided on said housing and formed so as to restrict said member's position.

28. A connector connection structure comprising: a first connector on a housing accommodating an electric device mounted in a vehicle; a second connector shaped so as to be fitted into said first connector by inserting it with a force not smaller than a predetermined amount; and a rod-like insertion assist member connected, via a fulcrum, with an insertion assist mechanism for fitting said second connector into said first connector, said insertion assist mechanism being removed after fitting of said second connector into said first connector, wherein said rod-like insertion assist member generates said force not smaller than a predetermined amount for said second connector by applying, with its one end's position being restricted, a rotation force to another end, said second connector includes a contact joinable with a contact of said first connector to be electrically connected, said housing includes a restriction means for restricting the position of said one end, said insertion assist mechanism includes:

a first member rotatably supporting said rod-like insertion assist member and coming in contact with said second connector, a second member connected to said another end, provided in said first member, and movable in a direction parallel to an insertion direction of said second connector, and a third member connected to said one end, and said restriction means is a protrusion provided on said housing and formed so as to restrict a position of said third member in said insertion direction.

* * * * *